US006698372B2

(12) United States Patent
Hobdy et al.

(10) Patent No.: US 6,698,372 B2
(45) Date of Patent: Mar. 2, 2004

(54) TURRET MOORING SYSTEM AND METHOD FOR INSTALLATION

(75) Inventors: Miles A. Hobdy, Houston, TX (US); L. Terry Boatman, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 46 days.

(21) Appl. No.: 09/982,195

(22) Filed: Oct. 18, 2001

(65) Prior Publication Data

US 2002/0073906 A1 Jun. 20, 2002

Related U.S. Application Data

(60) Provisional application No. 60/241,694, filed on Oct. 19, 2000.

(51) Int. Cl.[7] ..... B63B 22/02
(52) U.S. Cl. ..... 114/230.12
(58) Field of Search ..... 114/293, 230.1, 114/230.13, 230.12

(56) References Cited

U.S. PATENT DOCUMENTS 4,490,121 A 12/1984 Coppens et al.
4,637,335 A 1/1987 Pollack
4,955,310 A 9/1990 Pollack
5,468,166 A 11/1995 Breivik et al.
5,515,804 A 5/1996 Pollack
5,755,607 A * 5/1998 Boatman et al. ..... 441/5
5,893,334 A 4/1999 Poranski

* cited by examiner

*Primary Examiner*—Ed Swinehart
(74) *Attorney, Agent, or Firm*—Gary L. Bush; Andrews Kurth LLP

(57) ABSTRACT

An improved turret for a turret mooring arrangement characterized by the turret including an upper section and a lower section which are coupled together by a flex joint. The turret mooring arrangement also includes a turret insert tube with a lower section that is rotatably coupled to the vessel by a radial bearing assembly. The radial bearing assembly includes an outer member having an outer profile arranged and designed to cooperate with a complementary profile in the interior of the turret insert tube so that the outer member is turned by the turret insert tube when the vessel rotates about said turret, without fixed attachment of the outer member to the turret insert tube. Methods of installing a turret and lower bearing assembly within a turret insert tube of a vessel are also disclosed.

19 Claims, 2 Drawing Sheets

100
34
41
53
6
53
35
35
60
22
22
31
52
50
7
30
91
72
39
91
37
70
40
71
37
81
82
82
36
32
73
27
90
93
94
92
92
91

FIG. 2
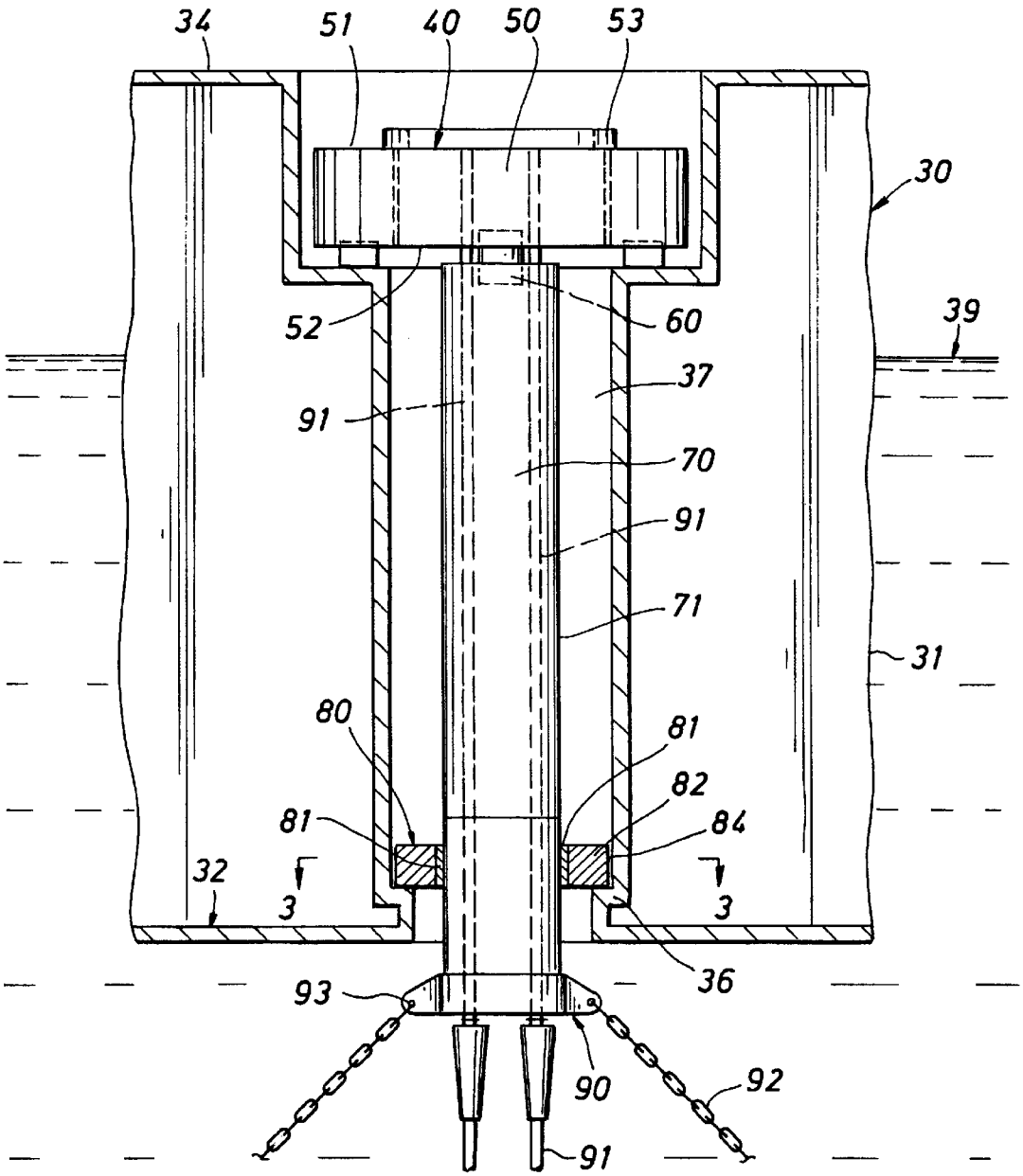
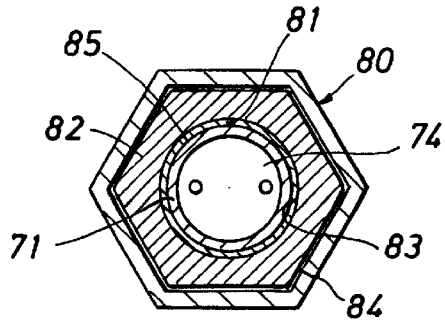
FIG. 3

TURRET MOORING SYSTEM AND METHOD FOR INSTALLATION

RELATED APPLICATION

This application claims the benefit of U.S. Provisional Patent Application Ser. No. 60/241,694, filed Oct. 19, 2000.

BACKGROUND OF THE INVENTION

1. Field of the Invention

This invention relates generally to mooring systems for offshore vessels and Floating Production Units ("FPUs") such as Floating Storage and Offloading vessels ("FSOs") and Floating Production Storage and Offloading vessels ("FPSOs") and in particular to turret mooring arrangements, or systems, where a turret is rotatably supported on the vessel and where the turret is fixed to the sea bed by anchor legs so that the vessel can weathervane about the turret.

2. Description of the Prior Art

Turret mooring systems have been used for some time for FPUs and especially with FPSOs. FPSOs are production platforms typically constructed on tanker hulls. FPSOs are the most flexible of FPUs in terms of water depth and sea conditions due to their variation in moorings and ship shape configurations. FPSOs are spread moored (anchored directly to the sea floor), attached via an internal or external turret, which is moored to the sea floor or detachably secured to a separately floating buoy that is moored to the sea floor. FPSOs have excellent storage and topside facilities configurations due to their large size and ship shape. Further, many modem FPSOs are turret moored.

FPSOs compete with other kinds of floating production units such as semi-submersibles, spars, and tension leg platforms. Their competitiveness depends on their advantages and disadvantages.

As mentioned above, the present invention is directed to a turret mooring arrangement. Prior turret mooring arrangements are known in the art. For example, U.S. Pat. No. 3,335,690 to Busking shows a permanently anchored turret which is rotatably supported from a frame that extends from the bow of the vessel.

U.S. Pat. No. 4,650,431 to Kentosh illustrates a turret which can be disconnected from a frame secured from the bow of a vessel.

U.S. Pat. No. 4,490,121 to Coppens illustrates a disconnectable turret which is rotatably secured from the bow of the vessel.

U.S. Pat. No. 4,955,310 to Pollack illustrates a bearing system for mounting a turret on the outer beams of a vessel. The bearings shown in this patent allow the turret to pivot about upper and lower horizontal axes.

U.S. Pat. No. 5,515,804 to Pollack illustrates a bearing system for a turret with a generally rigid upper mount and including a resiliently deflectable support structure that includes a plurality of elastomeric shear pads.

U.S. Pat. No. 5,468,166 to Breivik et al. shows a disconnectable buoy which is receivable into a submerged receiving space of the vessel. The outer portion of the buoy is latched to the vessel, but has a central member of smaller diameter which is rotatably mounted in the outer member and has a through-going passage for hydrocarbon to be transported via the buoy. A flexible joint is provided at the top end of the central member. The flexible joint is secured to an inner part of a fluid swivel.

Identification of Objects at the Invention

A primary object of the present invention is to provide a less expensive turret mooring arrangement for a FPSO.

Another object of the present invention is to provide a turret mooring arrangement with a smaller turret than conventional FPSOs.

An additional object of the present invention is to provide a less expensive turret mooring arrangement for rotatably mounting a turret on a vessel under conditions of a vessel ovaling and moment loading on the upper axial/radial bearing.

SUMMARY OF THE INVENTION

The objects identified above along with other features and advantages of the invention are provided with a turret configuration for a low cost internal turret in which the turret includes an upper section, a lower section and a flex joint coupled therebetween. The turret mooring arrangement is rotatably supported on a vessel that floats at the surface of the sea and that can weathervane about the turret. The lower section of the turret is anchored by at least one mooring line which extends to the sea floor for anchoring the turret in a substantially geostationary position.

The upper section includes an axial/radial bearing assembly. This assembly permits the vessel to weathervane about the turret, yet resists other moment loadings caused by weather conditions, including sea conditions, causing the vessel to heave, pitch and yaw in the sea.

The flex joint is located just below the upper axial/radial bearing assembly. It is designed to minimize the effects of moment loading acting upon the upper axial/radial bearing assembly.

The lower section includes a lower radial bearing assembly comprising a lower radial bearing and lower bearing outer housing. The lower bearing outer housing is strategically shaped to correspond with the hull of the vessel or an outboard device attached to the vessel. Because the lower bearing outer housing is not permanently connected to the vessel or outboard device, no requirements exist to integrally fabricate the assembly to the vessel or outboard device. Instead, such an assembly can be fabricated separately, thereby reducing costs. Moreover, the shape of the lower radial bearing assembly housing can be more easily customized as desired or necessary to facilitate capturing of the turret mooring arrangement by the vessel. For example, the outer profile of the lower bearing outer housing may be polygonally shaped, frusto-conically shaped, or any other shape desired.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which:

FIG. 2, showing another embodiment of the invention, illustrates an arrangement of a turret for a floating vessel similar to that of FIG. 1 but with the lower bearing outer housing shown as a polygon which allows the turret to be installed by lowering the turret assembly into the moon pool from above the vessel's main deck; and FIG. 3 is a cross-sectional view of the lower turret mooring arrangement across lines 3-3 in FIG. 2.

Figure 1:
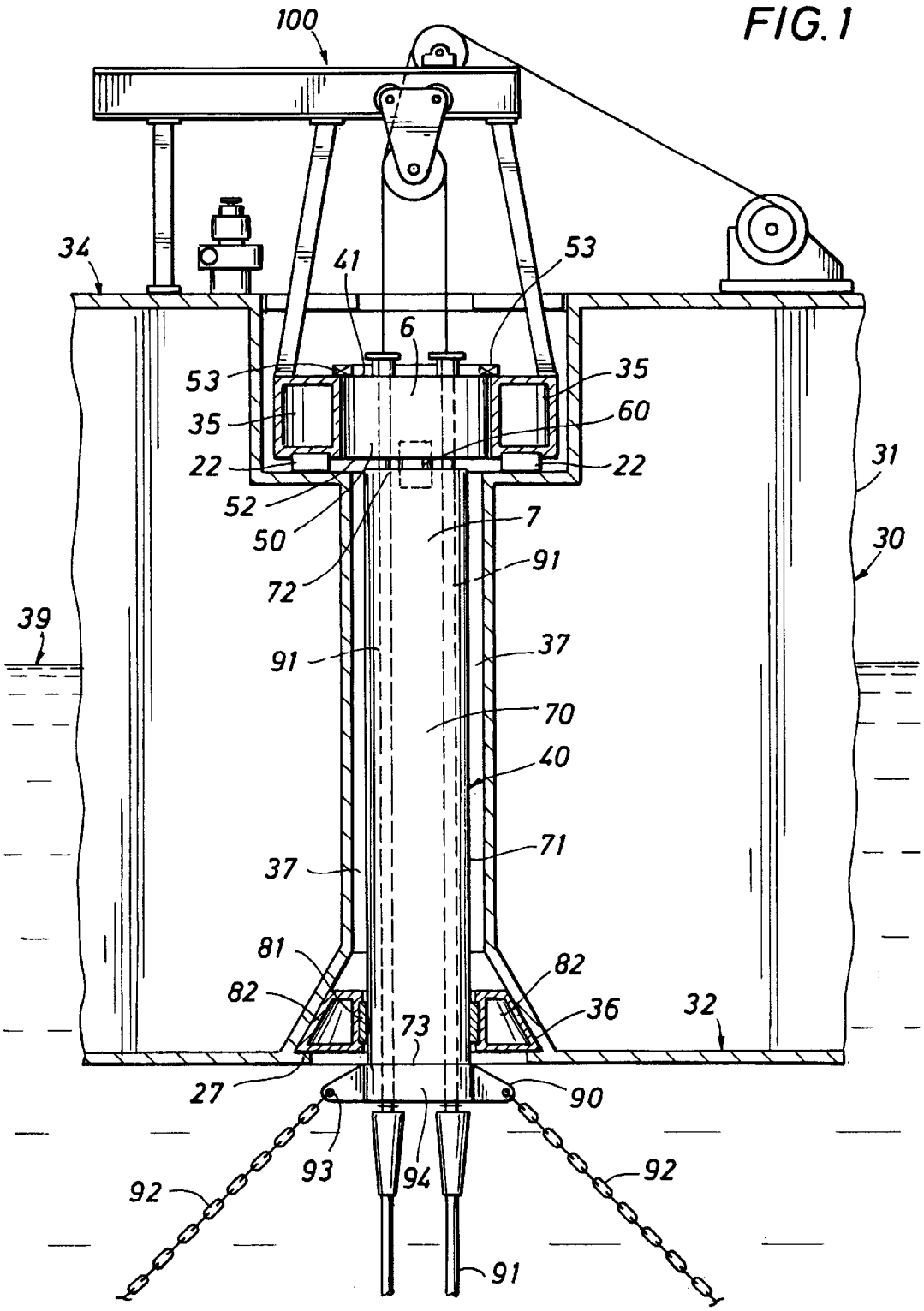
FIG. 1, showing one embodiment of the invention, illustrates an arrangement of a turret for a floating vessel with an upper turret coupled to a lower turret by a flex-joint/universal joint and with a lower bearing outer housing of frusto-conical shape, which requires installation of the lower bearing arrangement from below the vessel's keel.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

FIG. 1 illustrates a first embodiment of the invention. The turret mooring arrangement 40 includes upper section 50, lower section 70, and flex joint 60 coupled therebetween. Upper section 50 includes first upper section end 41, second upper section end 52, upper axial/radial bearing assembly 53, and an upper section cavity 6 within upper section 50. The cavity 6 within upper section 50 permits risers 91 or other equipment, devices, tubulars, etc. to pass through upper section 50. Riser tubes could alternatively be provided for the passage of risers 91 through the turret sections. Risers 91 are drawn upward with a winch and sheave arrangement 100, known to those skilled in the art of offshore mooring arrangements. Upper section 50 is rotatably coupled via upper axial/radial bearing assembly 53 to rigid mounting rings 35 which are coupled to flexible/spring elements 22 which are in turn mounted to the vessel 30. The upper axial/radial bearing assembly 53 is designed to allow the vessel 30 to weathervane about the turret mooring arrangement 40.

Flex joint 60 may be a typical universal joint, e.g., Hooke's joint, or a tapered stress joint of metallic or composite construction, or a flex joint utilizing elastomeric or composite materials acting as the flexible element. Preferably, flex joint 60 provides two degrees of freedom of movement.

In one specific embodiment, flex joint 60 is located in close proximity to the horizontal plane of upper axial/radial bearing assembly 53. Another way to describe the preferred location of flex joint 60 is that the height of upper section 50 is small compared to the height of lower section 70 whereby flex joint 60 is positioned a small distance from upper axial/radial bearing assembly 53 relative to the combined height of upper section 50 and lower section 70.

By locating flex joint 60 close to the horizontal plane of upper axial/radial bearing assembly 53, coupled with the release of two degrees of freedom by flex joint 60, the moment loading experienced by upper axial/radial bearing assembly 53 is minimized, thereby reducing the capacity requirements of upper axial/radial bearing assembly 53. Additionally, the reduction in moment loading greatly reduces the size of (or may completely eliminate the need for) flexible/spring elements 22 between upper axial/radial bearing assembly 53 and the structure of vessel 30 to account for vessel 30 ovaling due to environmental forces. This feature provides cost savings because the flexible/spring elements 22 required of conventional systems to provide this movement are costly and technically challenging. Locating the flex joint 60 near the horizontal plane of upper axial/radial bearing assembly 53 also reduces the horizontal load acting upon flex joint 60 as a result of reacting mooring loads.

Lower section 70 includes lower section shaft 71, top end 72, bottom end 73, lower section cavity 7 running through lower section 70, lower radial bearing 81, and lower bearing outer housing 82. The lower section cavity 7 running through lower section 70 permits risers 91 or other equipment, devices, tubulars, etc. to pass through lower section 70. Lower section 70 is rotatably coupled via lower radial bearing 81 to lower bearing outer housing 82 which abuts against vessel 30 at a frusto-conically shaped recess 36. This lower radial bearing assembly 81, 82 allows the vessel 30 to weathervane about the stationary turret mooring arrangement 40. Additionally, support piece 27 may be fabricated (e.g. by welding) at recess 36 after the lower turret section 70 has been pulled upwardly into place to provide additional support to maintain lower bearing outer housing 82 in place against the inside surface of recess 36.

Upper section 50 and lower section 70 may have any shape desired or necessary to facilitate capture of upper section 50 and lower section 70 by vessel 30. Preferably upper section 50 and lower section 70 have a circular cross-section and the diameter of upper section 50 is larger than the diameter of lower section 70.

While lower bearing outer housing 82 may have any shape desired or necessary to be sufficiently captured by hull 31 of vessel 30, or by an outboard frame connected to the vessel, to stabilize turret mooring arrangement 40, lower bearing outer housing 82 in the embodiment of FIG. 1 is frusto-conical in shape. Accordingly, vessel 30 has a corresponding frusto-conically shaped recess 36 for lower bearing outer housing 82. Therefore, lower bearing outer housing 82, and thus turret mooring arrangement 40, must be captured by vessel 30 from below keel 32 of vessel 30. For example, vessel 30 includes turret insert tube 37, i.e., moonpool 37, for receiving turret mooring arrangement 40. Disposed along keel 32 of vessel 30 is recess 36 that is in communication with moonpool 37. Turret mooring arrangement 40 is pulled into vessel 30 from the bottom of the vessel.

Vessel 30 may also capture turret mooring arrangement 40 through an outboard structure and is designed to capture lower bearing outer housing 82 in the same manner as described above. Such outboard arrangements are known in the art of offshore vessel mooring design.

FIG. 2 shows another embodiment of the invention where an arrangement of a turret for a floating vessel is similar to that of FIG. 1 but with the lower bearing outer housing 82 shown as a polygon which allows the turret to be installed by lowering the turret assembly into the moonpool 37 from above the vessel's main deck. This embodiment also includes an upper section 50, lower section 70, and flex joint 60 coupled therebetween.

The upper portion of the lower section 70 functions in an identical manner to that of FIG. 1. The lower bearing outer housing 82 is polygonally shaped. Accordingly, vessel 30 has a corresponding polygonally shaped recess 36 for receiving lower bearing outer housing 82. Therefore, lower bearing outer housing 82 permits turret mooring arrangement 40 to be installed by lowering turret mooring arrangement 40 into moonpool 37 from above deck 34 of vessel 30, i.e., in the direction of from deck 34 to keel 32. The lower radial bearing 81 allows the vessel 30 to weathervane about the stationary turret mooring arrangement 40 when the vessel 30 abuts against and rotates the lower bearing outer housing 82.

As with the embodiment shown in FIG. 1, it is to be understood that vessel 30 may also capture turret mooring arrangement 40 through an outboard mechanism and is designed to capture lower bearing outer housing 82 in the same manner as discussed above. Such outboard mechanisms are within the skill of routineers in the art of offshore mooring systems.

FIG. 3 is a cross-section looking down from line 3—3 of FIG. 2. Lower radial bearing assembly 80 includes lower bearing outer housing 82, a continuous or segmented bushing, or inner sliding surface 83 constructed of either metallic or a composite material that is mounted on lower bearing outer housing 82, and outer profile 84. Outer profile 84 is arranged and designed to cooperate with a complementary profile in the interior of turret insert tube 37 (FIG. 2) so that lower bearing outer housing 82 is turned by the interior wall of turret insert tube 37 (FIG. 2) when vessel 30 rotates about turret mooring arrangement 40 (FIG. 2), without fixed attachment for lower bearing outer housing 82 to the wall of turret insert tube 37 (FIG. 2).

The lower bearing assembly 80 also includes lower radial bearing or journal 81 that is permanently secured to lower turret shaft 71. Lower radial bearing 81 includes outer sliding surface 85. Inner sliding surface 83 and outer sliding surface 85 are arranged and designed to rotate with respect to each other thereby providing sliding radial support of the lower turret section 71 with respect to the vessel and turret insert tube 37.

While inner sliding surface 83 and outer sliding surface 85 are described as sliding surfaces, it is to be understood that any surface that permits movement along inner sliding surface 83 and outer sliding surface 85 to facilitate relative rotation may be considered to be a sliding surface. For example, one or both of inner sliding surface 83 and outer sliding surface 85 may include rollers to facilitate rotational movement. Alternatively, one or more of inner sliding surface 83 and outer sliding surface 85 may include ball bearings to facilitate relative rotational movement.

FIGS. 1 and 2

As shown in FIGS. 1 and 2, lower bearing outer housing 82 is not mounted to vessel 30. Instead, the design of lower bearing outer housing 82 profile is such that its shape is polygonal (FIG. 2) or frusto-conical (FIG. 1) as discussed above. These shapes permit lower bearing outer housing 82 to rotate with, and transmit a radial load onto, vessel 30 without a fixed or permanent attachment of lower bearing outer housing 82 to vessel 30. Therefore, an inexpensive turret installation may be achieved by reducing the fabrication work required to hull 31 of vessel 30. The configuration also permits a less complex construction approach to the components of lower radial bearing assembly 80, because all of the pieces can be made and fitted together prior to installation.

As illustrated in FIGS. 1 and 2, turret mooring arrangement 40 includes chain table 90 having a cavity 94 through which risers 91 pass. Mooring lines 92 are secured to chain table 60 and to the sea floor (not shown) by any method, and through any means, known to persons skilled in the art, provided that mooring lines 92 anchor turret mooring arrangement 40 is an substantially geostationary position. As shown in FIGS. 1 and 2, mooring lines 92 are secured to chain table 90 by attaching mooring lines at points 93 as known in the art of anchoring systems. Mooring lines 92 (e.g., chains, wire rope, synthetic rope, etc.) do not have to be secured directly to the sea floor. For example, mooring lines 92 may be secured to submerged buoys that are secured directly to the sea floor.

Risers 91 (FIGS. 1 and 2) in communication with one or more sources of hydrocarbon fluid pass through lower section 70 and upper section 50 and are in communication with deck equipment, e.g., winches, production equipment, etc. Accordingly, turret mooring arrangement 40 permits at least one riser 91 (e.g., two risers 91 as shown in FIGS. 1 and 2), to be in fluid communication with the vessel. The vessel 30 is capable of weathervaning about the axis of the mooring arrangement 40 because of the rotational support of axial/radial bearing assembly 53 and lower radial bearing assembly 81, 82. All other moments are reduced via flex joint 60.

Method of Installation

In another aspect of the present invention, methods of installing a turret mooring arrangement 40 include the steps of fixing lower radial bearing 81 and lower bearing outer housing 82 to the bottom end of the turret mooring arrangement 40 and installing turret mooring arrangement 40 inside turret insert tube 37.

In one embodiment of the method (e.g., the method of installing the structure of FIG. 1), the turret mooring arrangement 40 is installed inside turret insert tube 37 by passing turret mooring arrangement 40 first through deck 34 of vessel 30, i.e., in a direction from deck 34 to keel 32. In another embodiment of the method (e.g., the method of installing the structure of FIG. 2), lower radial bearing 81 and lower bearing outer housing 82 are installed inside turret insert tube 37 by passing turret mooring arrangement 40 first through keel 32 of vessel 30, i.e., in the direction of from keel 32 to deck 34.

It is to be understood that the invention is not limited to the exact details of construction, operation, exact materials, or embodiments shown and described, as obvious modifications and equivalents will be apparent to one skilled in the art. For example, the outer member 37 may have any shape desired or necessary to facilitate stable capture of the turret mooring arrangement. Further, flex joint 60 may be any of the examples identified herein or any other device known to persons of ordinary skill in the art that permits relative movement about two orthogonal horizontal axes between upper turret section 50 and lower turret section 71. Moreover, the components of the turret mooring arrangement may be manufactured out of any material and through any method known to persons of ordinary skill in the art. Accordingly, the invention is therefore to be limited only by the scope of the claims.

What is claimed is:

1. In a mooring arrangement which includes a vessel that floats at the surface of the sea and that can weathervane about a turret which is rotatably supported on said vessel and wherein said turret has a lower end anchored by at least one mooring line which extends to the sea floor for anchoring said turret in a substantially geostationary position, an improvement characterized by said turret including an upper section and a lower section which are coupled together by a load-bearing flex joint wherein, said upper section of said turret is rotatably coupled to said vessel by an axial/radial bearing assembly, and said lower section of said turret is rotatably coupled to said vessel by a radial bearing assembly.

2. The mooring arrangement of claim 1 wherein said flex joint is a universal joint.

3. The mooring arrangement of claim 1 wherein said flex joint is a tapered stress joint.

4. The mooring arrangement of claim 1 wherein said flex joint includes elastomeric material acting as a flexible element.

5. The mooring arrangement of claim 1 wherein said flex joint includes composite materials acting as a flexible element.

6. The mooring arrangement of claim 1 wherein said upper section of said turret is rotatably supported by an axial/radial bearing on said vessel and said flex joint is connected between said upper section and said lower section at a position at the same level or below said axial/radial bearing of said turret.

7. The mooring arrangement of claim 1 wherein a height of said upper section of said turret is small compared to a height of said lower section of said turret, said upper section of said turret is rotatably supported with respect to said vessel by an axial/radial bearing assembly, said flex joint being connected between a bottom end of said upper section of said turret and a top end of said lower section of said turret, whereby said flex joint is positioned a small distance from said axial/radial bearing assembly relative to the combined height of said upper section of said turret and said lower section of said turret.

8. The mooring arrangement of claim 1, wherein said turret is placed within a turret insert tube of said vessel, and wherein said radial bearing assembly includes an inner member secured about said lower section of said turret, said inner member having an outer sliding surface, and an outer member has an inner sliding surface arranged and designed to slide on said outer sliding surface of said inner member, said outer member having an outer profile arranged and designed to cooperate with a complementary profile in the interior of said turret insert tube so that the outer member is turned by said turret insert tube when said vessel rotates about said turret, without fixed attachment of said outer member to said turret insert tube.

9. The mooring arrangement of claim 8 wherein said outer profile of said outer member is of frusto-conical shape.

10. The mooring arrangement of claim 8 wherein said outer profile of said outer member is in the shape of a polygon.

11. In a mooring arrangement which includes a vessel that floats at the surface of the sea and that can weathervane about a turret which is rotatably supported on said vessel and wherein said turret has a lower end anchored by at least one mooring line which extends to the sea floor for anchoring said turret in a substantially geostationary position, an improvement characterized by said turret being placed within a turret insert tube of said vessel said turret being rotatably supported at a top end by an axial/radial bearing assembly and at a bottom end by a radial bearing assembly, wherein said radial bearing assembly includes an inner member secured about said lower end of said turret, said inner member having an outer sliding surface, and an outer member having an inner sliding surface arranged and designed to slide on said outer sliding surface of said inner member, said outer member having an outer profile which is arranged and designed to cooperate with a complimentary profile in the interior of said turret insert tube so that the outer member is turned by said turret insert tube when said vessel rotates about said turret, without fixed attachment of said outer member to said turret insert tube.

12. The mooring arrangement of claim 11 wherein said outer profile of said outer member is a frusto-conical shape.

13. The mooring arrangement of claim 11 wherein said outer profile of said outer member is in the shape of a polygon.

14. The mooring arrangement of claim 11 wherein said turret insert tube is placed with said vessel.

15. The mooring arrangement of claim 11 wherein said turret insert tube is supported from a structure at an end of said vessel.

16. A method of installing a turret having a radial bearing assembly within a turret insert tube of a vessel having a deck and a keel comprising the steps of:

fixing a radial bearing assembly to a bottom end of said turret, said radial bearing assembly including an inner member secured about said lower end of said turret, said inner member having an outer sliding surface and an outer member having an inner sliding surface arranged and designed to slide on said outer sliding surface of said inner member, said outer member having an outer profile, and installing said radial bearing assembly fixed to said turret inside said turret insert tube, said turret insert tube having an inner profile which cooperates with said outer profile of said outer member to cause said outer member of said radial bearing assembly to rotate with said vessel where said vessel rotates about said turret.

17. The method of claim 16 wherein said turret is installed inside said turret insert tube by passing said turret through said turret insert tube in the direction of from said deck to said keel.

18. The method of claim 16 wherein said turret is installed inside said turret insert tube by passing said turret through said turret insert tube in the direction of from said keel to said deck.

19. In a mooring arrangement which includes a vessel that floats at the surface of the sea and that can weathervane about a turret which is rotatably supported on said vessel and wherein said turret has a lower end anchored by at least one mooring line which extends to the sea floor for anchoring said turret in a substantially geostationary position, an improvement characterized by said turret including an upper section that is rotatably coupled to said vessel by an axial/radial bearing assembly, and said turret including a lower section that is connected to said upper section by a load-bearing flex joint and wherein said lower section of said turret is rotatably coupled to said vessel by a radial bearing assembly.

* * * * *